US009421418B2

(12) United States Patent
Skrashevskiy

(10) Patent No.: US 9,421,418 B2
(45) Date of Patent: Aug. 23, 2016

(54) MULTI-FUNCTIONAL EXERCISE SHAFT DEVICE

(71) Applicant: Oleg Skrashevskiy, Los Angeles, CA (US)

(72) Inventor: Oleg Skrashevskiy, Los Angeles, CA (US)

( * ) Notice: Subject to any disclaimer, the term of this patent is extended or adjusted under 35 U.S.C. 154(b) by 0 days.

(21) Appl. No.: 14/494,258

(22) Filed: Sep. 23, 2014

(65) Prior Publication Data

US 2016/0082314 A1 Mar. 24, 2016

(51) Int. Cl.

| | |
|---|---|
| ***A63B 23/035*** | (2006.01) |
| ***A63B 21/02*** | (2006.01) |
| ***A63B 21/015*** | (2006.01) |
| ***A63B 21/00*** | (2006.01) |

(52) U.S. Cl.

CPC ..... *A63B 23/03533* (2013.01); *A63B 21/00069* (2013.01); *A63B 21/015* (2013.01); *A63B 21/023* (2013.01); *A63B 21/1446* (2013.01); *A63B 21/1465* (2013.01); *A63B 21/1469* (2013.01); *A63B 21/1492* (2013.01); *A63B 21/1496* (2013.01)

(58) Field of Classification Search

CPC ..... A63B 21/02; A63B 21/022–21/025; A63B 21/04; A63B 21/0407; A63B 21/0428; A63B 21/0442; A63B 21/05; A63B 22/0012; A63B 22/06–22/0605; A63B 22/0694; A63B 2022/0647; A63B 23/03516; A63B 23/03533–23/03541; A63B 23/03575; A63B 23/0476; A63B 25/08

See application file for complete search history.

(56) References Cited

U.S. PATENT DOCUMENTS

| | | | | | |
|---|---|---|---|---|---|
| 4,351,527 | A * | 9/1982 | Crisp, Jr. | A63B 21/00043 | 482/121 |
| 4,618,141 | A | 10/1986 | Ashworth, Jr. | | |
| 4,625,963 | A * | 12/1986 | Lancellotti | A63B 21/04 | 482/130 |
| 4,739,984 | A | 4/1988 | Dranselka | | |
| 5,007,631 | A | 4/1991 | Wang | | |
| 5,071,119 | A | 12/1991 | Johnson | | |
| 5,080,353 | A * | 1/1992 | Tench | A63B 21/154 | 482/130 |
| 5,199,932 | A | 4/1993 | Liao | | |
| 5,913,756 | A | 6/1999 | Glaser | | |
| 5,928,115 | A | 7/1999 | Attoya, Jr. | | |
| D470,201 | S | 2/2003 | Paull | | |
| 6,852,070 | B1 * | 2/2005 | Herbert | A63B 71/0009 | 482/57 |
| 7,682,296 | B2 * | 3/2010 | Brown | A63B 21/0085 | 482/113 |
| 8,317,668 | B2 * | 11/2012 | Sales | A63B 21/04 | 482/140 |

* cited by examiner

*Primary Examiner* — Oren Ginsberg
*Assistant Examiner* — Jennifer M Deichl

(57) ABSTRACT

A multi-functional exercise shaft device facilitates performance of various exercises. The device includes a shaft having a first section slidable relative to a second section such that a length of the shaft is compressible. A biasing member resists compression of the shaft. Each of a pair of end caps is coupled to and covers a respective end of the shaft. Each of a pair of interior handles has a respective interior end coupled to the shaft. A pedal mechanism is coupled to the shaft. The pedal mechanism comprises a pedal housing, an axle extending through the pedal housing, a pair of pedal arms, and a pair of pedals. Each of the pedal arms is coupled to the axle such that the pedal arms extend from the pedal housing. Each of the pedals is rotatably coupled to an associated one of the pedal arms.

18 Claims, 6 Drawing Sheets

MULTI-FUNCTIONAL EXERCISE SHAFT DEVICE

BACKGROUND OF THE DISCLOSURE

Field of the Disclosure

The disclosure relates to exercise devices and more particularly pertains to a new exercise device for facilitating performance of various exercises.

SUMMARY OF THE DISCLOSURE

An embodiment of the disclosure meets the needs presented above by generally comprising a shaft having a first section slidable relative to a second section such that a length of the shaft is compressible. A biasing member resists compression of the shaft. Each of a pair of end caps is coupled to and covers a respective end of the shaft. Each of a pair of interior handles has a respective interior end coupled to the shaft. A pedal mechanism is coupled to the shaft. The pedal mechanism comprises a pedal housing, an axle extending through the pedal housing, a pair of pedal arms, and a pair of pedals. Each of the pedal arms is coupled to the axle such that the pedal arms extend from the pedal housing. Each of the pedals is rotatably coupled to an associated one of the pedal arms.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
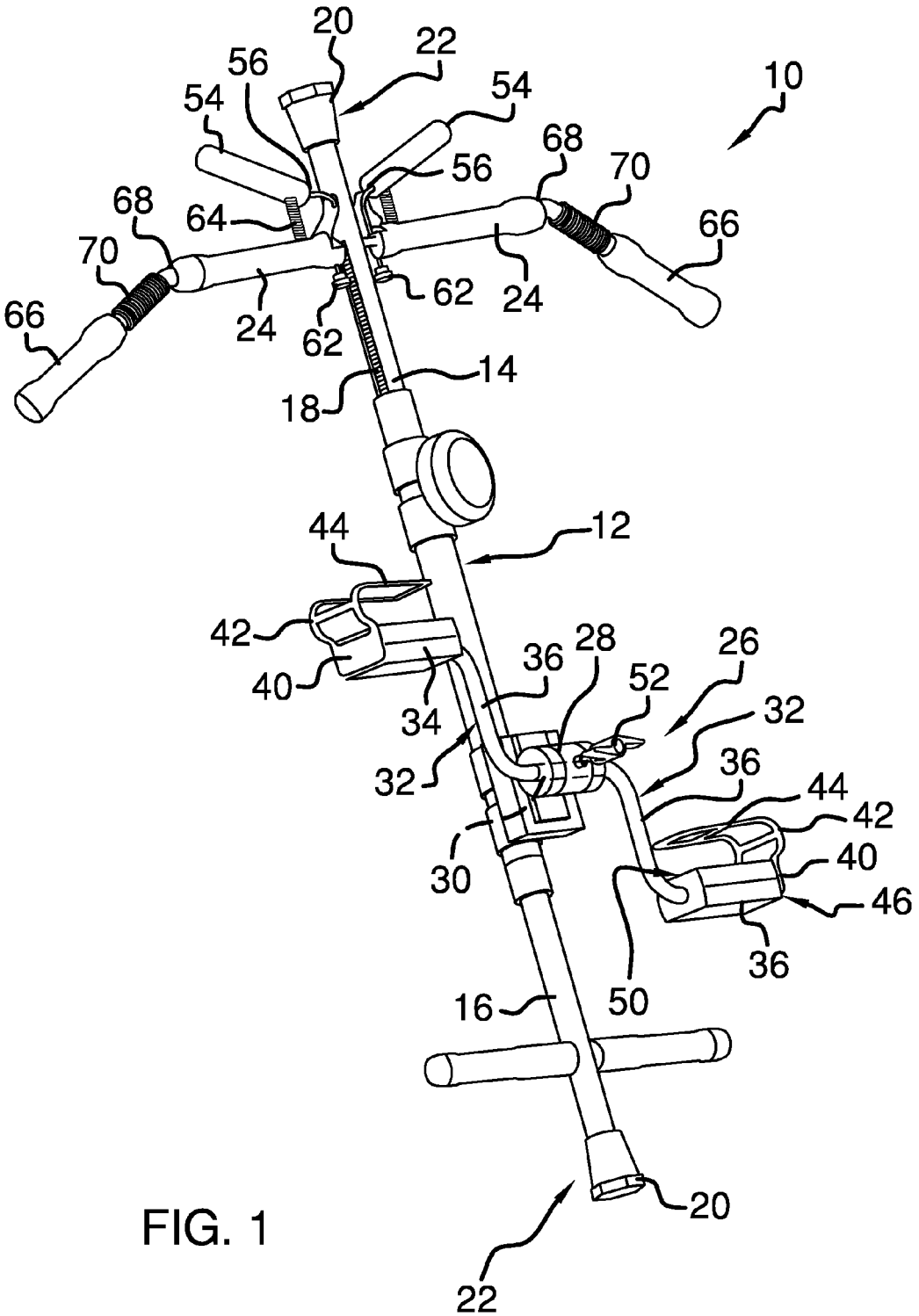
FIG. 1 is a bottom front side perspective view of a multi-functional exercise shaft device according to an embodiment of the disclosure.
Figure 2:
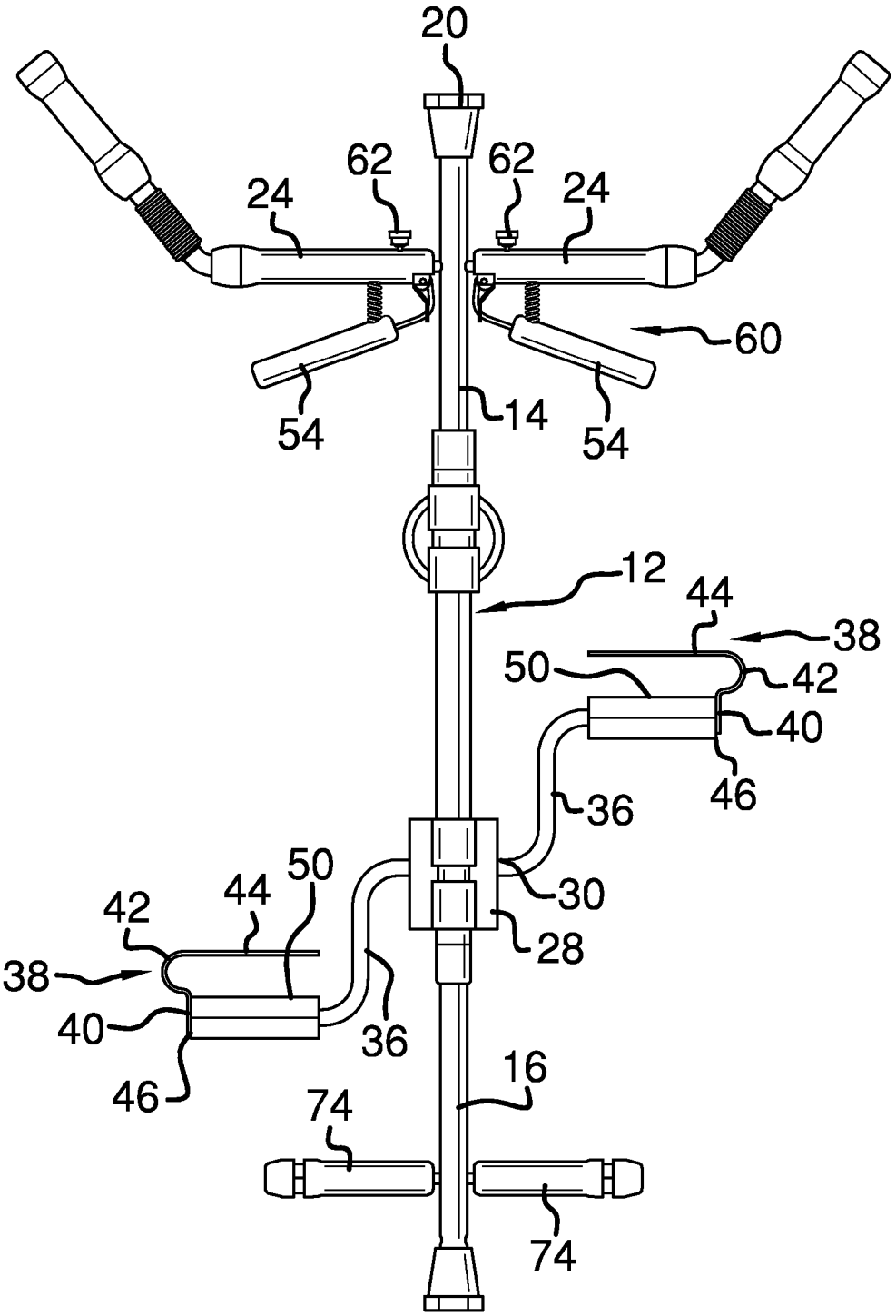
FIG. 2 is a back view of an embodiment of the disclosure with interior handles in an inverted position.
Figure 3:
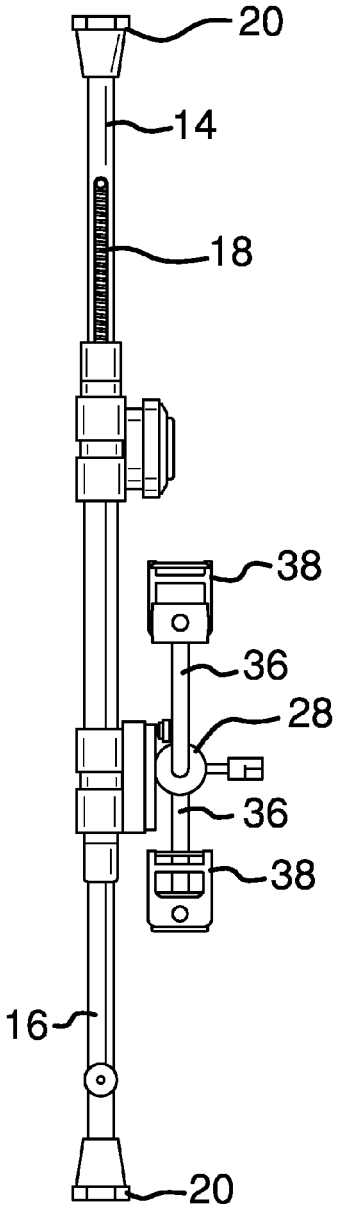
FIG. 3 is a side view of an embodiment of the disclosure.
Figure 4:
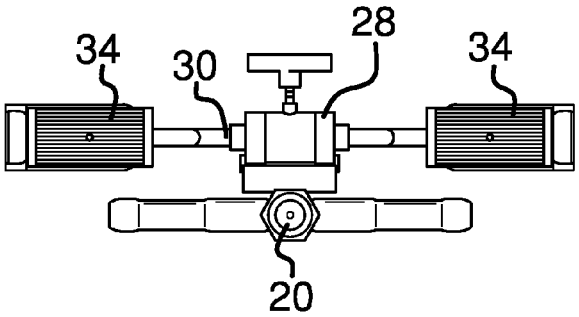
FIG. 4 is a bottom view of an embodiment of the disclosure.

With reference now to the drawings, and in particular to FIGS. 1 through 7 thereof, a new exercise device embodying the principles and concepts of an embodiment of the disclosure and generally designated by the reference numeral 10 will be described.

As best illustrated in FIGS. 1 through 7, the multi-functional exercise shaft device 10 generally comprises a shaft 12 having a first section 14 and a second section 16. The first section 14 is slidable relative to the second section 16 wherein a length of the shaft 12 is compressible. A biasing member 18 is coupled to the shaft 12 between the first section 14 and the second section 16 such that the biasing member 18 resists compression of the shaft 12. The biasing member 18 may also be coupled to the first section 14 and the second section 16 in a conventional manner such that the biasing member 18 also resists extension. Each of a pair of end caps 20 is coupled to and covers a respective end 22 of the shaft 12.

Figure 5:
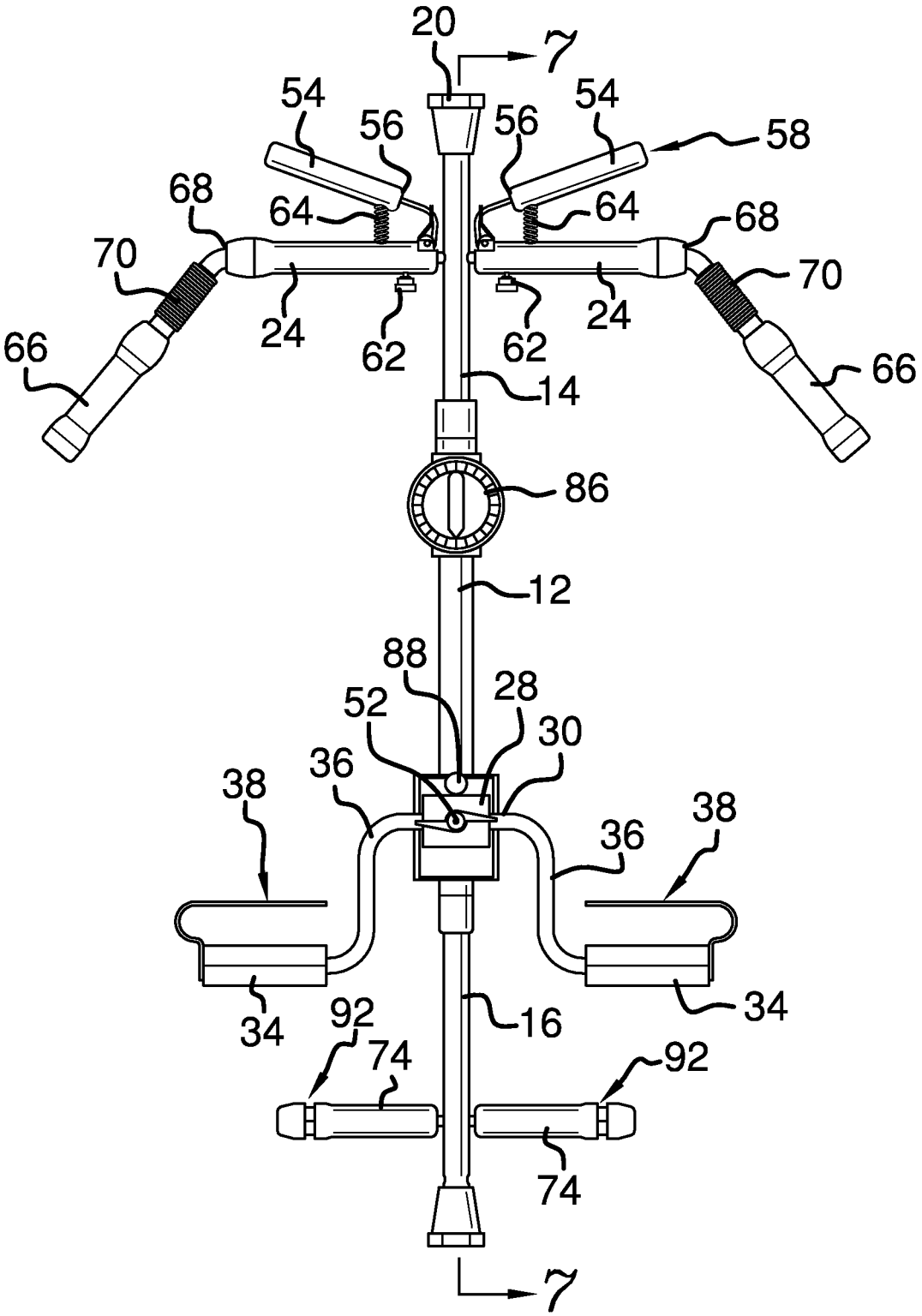
FIG. 5 is a front view of an embodiment of the disclosure employing an alternative pedal orientation.
Figure 6:
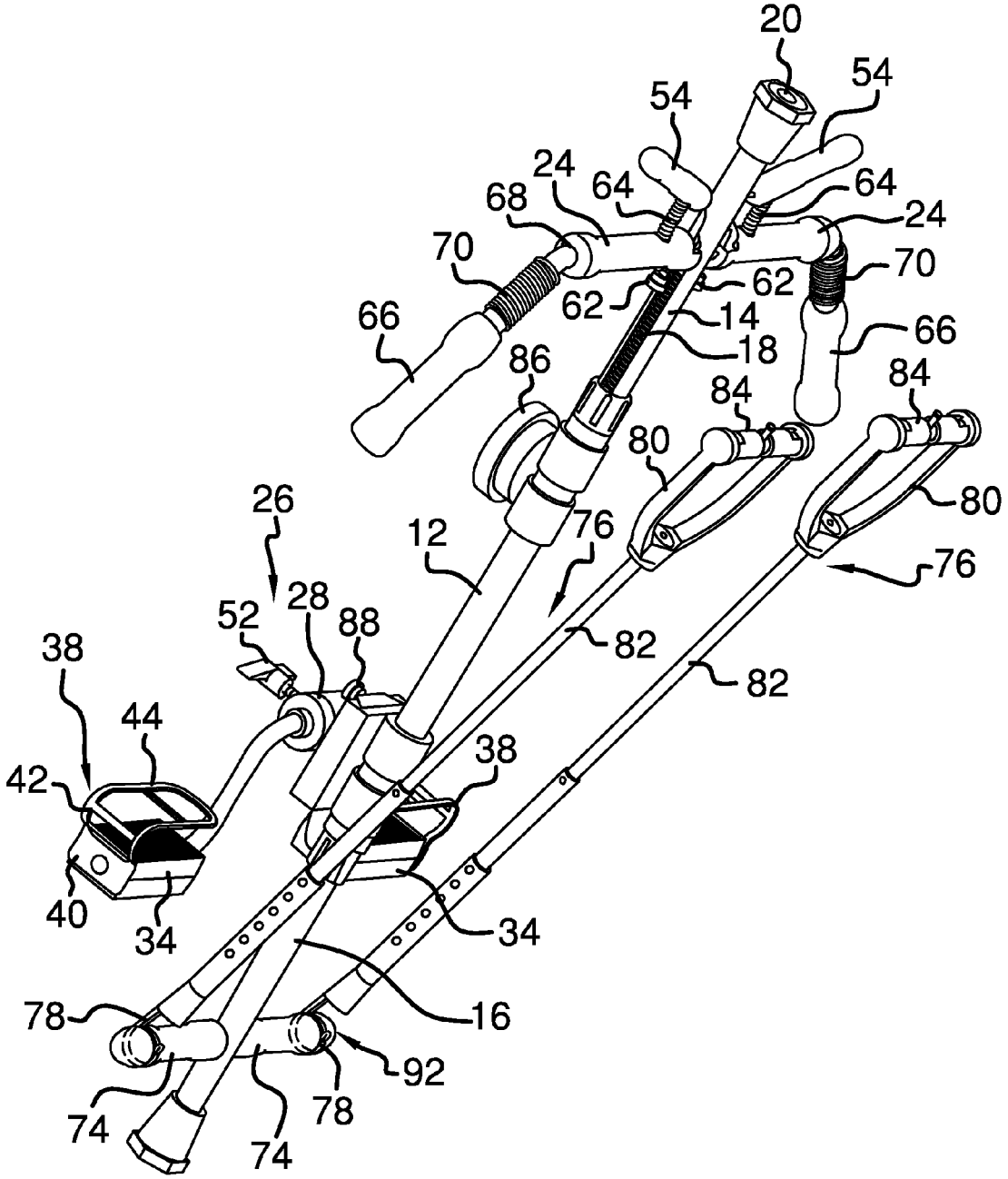
FIG. 6 is a top front side view of an embodiment of the disclosure.
Figure 7:
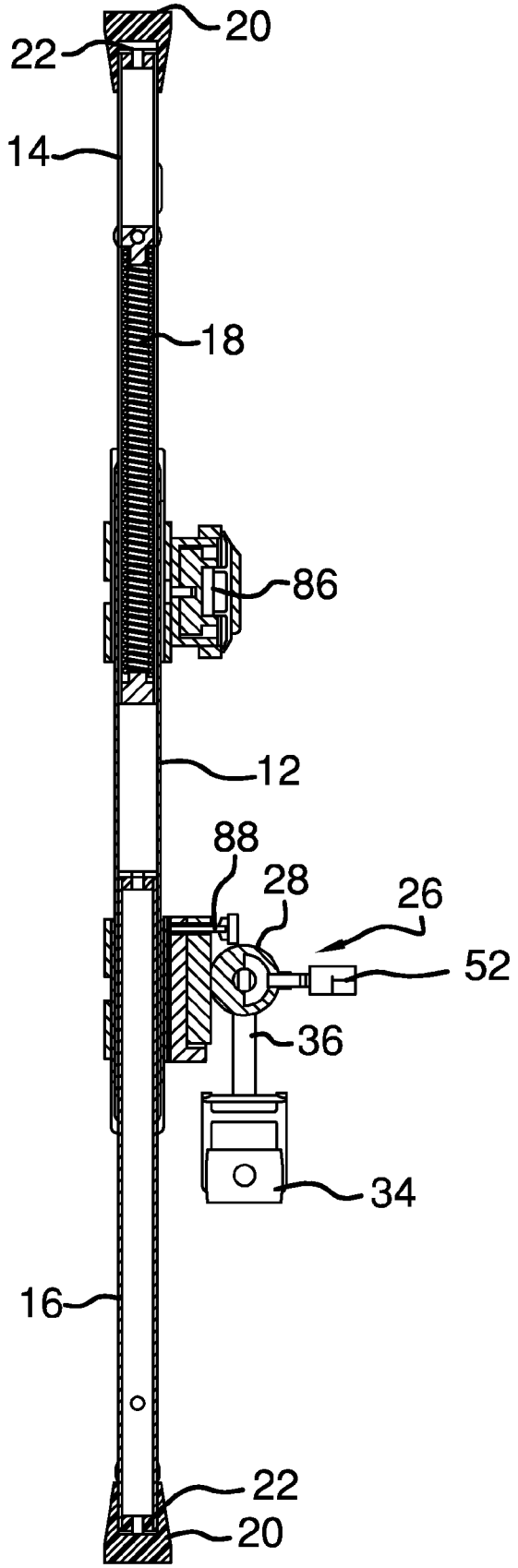
FIG. 7 is a cross-sectional view of an embodiment of the disclosure taken along line 7-7 of FIG. 5.

A pedal mechanism 26 is coupled to the second section 16 of the shaft 12. The pedal mechanism 26 comprises a pedal housing 28, an axle 30 extending through the pedal housing 28, a pair of pedal arms 32, and a pair of pedals 34. Each of the pedal arms 32 is coupled to the axle 30 such that the pedal arms 32 extend from opposite sides of the pedal housing 28. Each of the pedals 34 is rotatably coupled to an associated one of the pedal arms 32 in a conventional manner. The pedal arms 32 are coplanar. Each pedal arm 32 has a respective outer extent 36 relative to the pedal housing 28. The outer extents 36 of the pedal arms 32 may be provided in a first arrangement or a second arrangement. The outer extents 36 extend in parallel in one direction relative to the axle 30 in the first arrangement, as shown in FIG. 5, and the outer extents 36 of the pedal arms 32 extend in parallel in opposite directions relative to the axle 30 in the second arrangement as shown in FIG. 1. Each of a pair of pedal clips 38 is coupled to an associated one of the pedals 34. Each pedal clip 38 has a connection flange 40, an arcuate section 42, and a straight section 44. The connection flange 40 is coupled to an outer face 46 of the associated one of the pedals 34. The arcuate section 42 extends outwardly away from the connection flange 40 and curves back towards the shaft 12. Each straight section 44 is positioned in spaced parallel relationship to a broad face 50 of the associated one of the pedals 34. A tensioner 52 is coupled to the pedal housing 28. The tensioner 52 engages the axle 30 extending between the pedal arms 32 wherein adjustment of the tensioner 52 adjusts resistance to rotation of the axle 30 through operation of the pedal arms 34. The pedal housing 28 may be moved along a length of the shaft 12. A pin 88 may be used in a conventional manner to secure the pedal housing 28 in a desired position along the length of the shaft 12.

Each of a pair of interior handles 24 has a respective interior end 26 coupled to the first section of the shaft 12. The interior handles 24 is linearly aligned across the shaft 12 and positioned proximate one of the ends 22 of the shaft 12. Each of a pair of grips 54 has a proximal end 56 relative to the shaft 12. Each proximal end 56 is pivotally coupled relative to an associated one of the interior handles 24. Each of the interior handles 24 is perpendicular to and rotatable relative to the shaft 12 wherein each of the grips 54 is adjustable between an upper position 58, shown in FIG. 1, and a lower position 60, shown in FIG. 6, relative to the associated interior handle 24. A respective grip release 62 is coupled to each grip 54. Each grip release 62 the associated grip 54 in a static position relative to the associated interior handle 24. Each grip release 62 is disengageable such that disengagement of each grip release 62 permits adjustment of the associated grip 54 between the upper position 58 and the lower position 60. A respective resistance member 64 is coupled to each grip 54 wherein the grips 54 are urged to pivot away from the interior handles 24. Thus, grasping of the grips 54 and interior handles 24 allows a user to exercise by squeezing to urge the grip 54 towards the interior handle 24.

Each of a pair of outer handles 66 is removably coupled to a distal end 68 of a respective one of the interior handles 24 relative to the shaft 12. Each of a pair of coils 70 is coupled between an associated one of the outer handles 66 and an associated one of the interior handles 24 wherein the associated outer handle 66 is pivotable relative to the associated interior handle 24. At rest, the outer handles 66 are angled relative to the shaft 12 and the associated interior handle 24. Tension in the coils 70 allows a user to exercise by grasping the outer handles 66 and moving against the tension of the coils 70.

Each of a pair of foot rests 74 is coupled to and extends from the shaft 12. The foot rests 74 are linearly aligned across the shaft 12. The foot rests 74 are positioned between the pedal mechanism 26 and a second one of the ends 22 of the shaft 12.

A pair of auxiliary handles 76 may also be provided. Each auxiliary handle 76 comprises an attachment hook 78, a stirrup 80, and a post 82 coupled to and extending between the attachment hook 78 and the stirrup 80. The attachment hook 78 is coupleable to an associated one of the foot rests 74 and positionable in a respective slot 92. Each stirrup 80 has a straight portion 84 oriented transverse to the post 82. Each post 82 may be telescopic to adjust a distance between the stirrups 80 and the shaft 12. Each stirrup 80 may be coupled to the associated post 82 in a manner allowing for rotation of the stirrup relative to a longitudinal axis of the associated post 82. A timer 86 is coupled to the shaft 12 allowing a user to set a desired time for performing any particular exercise.

In use, the components of the device 10 may be adjusted to a variety of positions to provide resistance to movement allowing for multiple different forms of exercise to be performed. The timer may be set to indicate a desired duration of time to perform an exercise, or alternatively, to set a time limit in which to complete a number of repetitions of a particular exercise.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A multi-functional exercise shaft device comprising:

a shaft having a first section and a second section, said first section being slidable relative to said second section wherein a length of said shaft is compressible;

a biasing member coupled to said shaft between said first section and said second section such that said biasing member resists compression of said shaft;

a pair of end caps, each end cap being coupled to and covering a respective end of said shaft;

an pair of interior handles, said interior handles each having a respective interior end coupled to said shaft;

a pedal mechanism coupled to said shaft, said pedal mechanism comprising a pedal housing, an axle extending through said pedal housing, a pair of pedal arms, and a pair of pedals, each of said pedal arms being coupled to said axle such that said pedal arms extend from said pedal housing, each of said pedals being rotatably coupled to an associated one of said pedal arms;

a pair of grips, each of said grips having a proximal end relative to said shaft being pivotally coupled relative to an associated one of said interior handles;

a respective resistance member coupled to each said grip wherein said grips are urged to pivot away from said interior handles; and each of said interior handles being perpendicular to and rotatable relative to said shaft wherein each of said grips is adjustable between an upper position and a lower position relative to said associated interior handle.

2. The device of claim 1, further comprising said interior handles being linearly aligned.

3. The device of claim 1, further comprising a respective grip release coupled to each said grip, each said grip release securing an associated said grip in a static position relative to said associated interior handle, each said grip release being disengageable such that disengagement of each said grip release permits adjustment of said associated grip between said upper position and said lower position.

4. The device of claim 1, further comprising a pair of outer handles, each said outer handle being removably coupled to a distal end of a respective one of said interior handles.

5. The device of claim 4, further comprising a pair of coils, each said coil being coupled between an associated one of said outer handles and an associated one of said interior handles wherein said associated outer handle is pivotable relative to said associated interior handle.

6. The device of claim 1, further comprising a tensioner coupled to said pedal housing, said tensioner engaging an axle extending between said pedal arms wherein adjustment of said tensioner adjusts resistance to rotation of said axle.

7. The device of claim 1, further comprising said pedal arms being coplanar, said pedal arms having respective outer extents relative to said pedal housing.

8. The device of claim 7, further comprising said outer extents of said pedal arms extending in parallel in one direction relative to said axle.

9. The device of claim 7, further comprising said outer extents of said pedal arms extending in parallel in opposite directions relative to said axle.

10. The device of claim 1, further comprising a pair of pedal clips, each of said pedal clips being coupled to an associated one of said pedals.

11. The device of claim 10, further comprising each said pedal clip having a connection flange, an arcuate section, and a straight section, said connection flange being coupled to an outer face of said associated one of said pedals, said arcuate section extending outwardly away from said connection flange and curving back towards said shaft, each said straight section being positioned in spaced parallel relationship to a broad face of said associated one of said pedals.

12. The device of claim 1, further comprising a pair of foot rests coupled to and extending from said shaft, said foot rests being linearly aligned across said shaft, said foot rests being positioned between said pedal mechanism and said second end of said shaft.

13. A multi-functional exercise shaft device comprising:

a shaft having a first section and a second section, said first section being slidable relative to said second section wherein a length of said shaft is compressible;

a biasing member coupled to said shaft between said first section and said second section such that said biasing member resists compression of said shaft;

a pair of end caps, each end cap being coupled to and covering a respective end of said shaft;

an pair of interior handles, said interior handles each having a respective interior end coupled to said shaft;

a pedal mechanism coupled to said shaft, said pedal mechanism comprising a pedal housing, an axle extending through said pedal housing, a pair of pedal arms, and a pair of pedals, each of said pedal arms being coupled to said axle such that said pedal arms extend from said pedal housing, each of said pedals being rotatably coupled to an associated one of said pedal arms a pair of foot rests coupled to and extending from said shaft, said foot rests being linearly aligned across said shaft, said foot rests being positioned between said pedal mechanism and said second end of said shaft; and a pair of auxiliary handles, each auxiliary handle comprising an attachment hook, a stirrup, and a post coupled to and extending between said attachment hook and said stirrup, said attachment hook being coupleable to an associated one of said foot rests.

14. The device of claim 13, further comprising each said stirrup having a straight portion oriented transverse to said post.

15. The device of claim 13, further comprising each said post being telescopic.

16. The device of claim 1, further comprising a timer coupled to said shaft.

17. A multi-functional exercise shaft device comprising:

a shaft having a first section and a second section, said first section being slidable relative to said second section wherein a length of said shaft is compressible;

a biasing member coupled to said shaft between said first section and said second section such that said biasing member resists compression of said shaft;

a pair of end caps, each end cap being coupled to and covering a respective end of said shaft;

an pair of interior handles, said interior handles each having a respective interior end coupled to said shaft, said interior handles being linearly aligned;

a pedal mechanism coupled to said shaft, said pedal mechanism comprising a pedal housing, an axle extending through said pedal housing, a pair of pedal arms, and a pair of pedals, each of said pedal arms being coupled to said axle such that said pedal arms extend from said pedal housing, each of said pedals being rotatably coupled to an associated one of said pedal arms, said pedal arms being coplanar, said pedal arms having respective outer extents relative to said pedal housing;

a pair of pedal clips, each of said pedal clips being coupled to an associated one of said pedals, each said pedal clip having a connection flange, an arcuate section, and a straight section, said connection flange being coupled to an outer face of said associated one of said pedals, said arcuate section extending outwardly away from said connection flange and curving back towards said shaft, each said straight section being positioned in spaced parallel relationship to a broad face of said associated one of said pedals;

a tensioner coupled to said pedal housing, said tensioner engaging an axle extending between said pedal arms wherein adjustment of said tensioner adjusts resistance to rotation of said axle;

a pair of grips, each of said grips having a proximal end relative to said shaft being pivotally coupled relative to an associated one of said interior handles, each of said interior handles being perpendicular to and rotatable relative to said shaft wherein each of said grips is adjustable between an upper position and a lower position relative to said associated interior handle;

a respective grip release coupled to each said grip, each said grip release securing an associated said grip in a static position relative to said associated interior handle, each said grip release being disengageable such that disengagement of each said grip release permits adjustment of said associated grip between said upper position and said lower position;

a respective resistance member coupled to each said grip wherein said grips are urged to pivot away from said interior handles;

a pair of outer handles, each said outer handle being removably coupled to a distal end of a respective one of said interior handles;

a pair of coils, each said coil being coupled between an associated one of said outer handles and an associated one of said interior handles wherein said associated outer handle is pivotable relative to said associated interior handle.

a pair of foot rests coupled to and extending from said shaft, said foot rests being linearly aligned across said shaft, said foot rests being positioned between said pedal mechanism and said second end of said shaft;

a pair of auxiliary handles, each auxiliary handle comprising an attachment hook, a stirrup, and a post coupled to and extending between said attachment hook and said stirrup, said attachment hook being coupleable to an associated one of said foot rests, each said stirrup having a straight portion oriented transverse to said post, each said post being telescopic; and a timer coupled to said shaft.

18. The device of claim 17, further comprising said outer extents of said pedal arms being in one of a first arrangement and a second arrangement, said outer extends extending in parallel in one direction relative to said axle in said first arrangement, said outer extents of said pedal arms extending in parallel in opposite directions relative to said axle in said second arrangement.

* * * * *